US008705989B2

(12) United States Patent
Kawamura et al.

(10) Patent No.: US 8,705,989 B2
(45) Date of Patent: Apr. 22, 2014

(54) COLOR ELECTROPHOTOGRAPHIC IMAGE FORMING APPARATUS

(75) Inventors: Koji Kawamura, Susono (JP); Seiji Inada, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 775 days.

(21) Appl. No.: 12/713,778

(22) Filed: Feb. 26, 2010

(65) Prior Publication Data

US 2010/0239271 A1 Sep. 23, 2010

(30) Foreign Application Priority Data

Mar. 19, 2009 (JP) ..... 2009-067338

(51) Int. Cl.
*G03G 15/00* (2006.01)

(52) U.S. Cl.
USPC ..... 399/21

(58) Field of Classification Search
USPC ..... 399/16, 21
See application file for complete search history.

(56) References Cited

U.S. PATENT DOCUMENTS

| | | | | |
|---|---|---|---|---|
| 5,539,509 | A * | 7/1996 | Tomoe et al. | 399/159 |
| 6,785,504 | B2 | 8/2004 | Yasui et al. | |
| 7,444,100 | B2 * | 10/2008 | Sato | 399/110 |
| 7,586,508 | B2 | 9/2009 | Tamaru et al. | |
| 7,664,427 | B2 | 2/2010 | Kawasumi et al. | |
| 8,200,119 | B2 | 6/2012 | Okabe et al. | |
| 2005/0019074 | A1 * | 1/2005 | Suzaki | 399/392 |
| 2007/0059033 | A1 * | 3/2007 | Kitozaki | 399/110 |
| 2007/0160386 | A1 | 7/2007 | Kawamura | |
| 2007/0177899 | A1 | 8/2007 | Kawamura | |

FOREIGN PATENT DOCUMENTS

| | | | | |
|---|---|---|---|---|
| DE | 19548512 A1 * | 6/1997 | | A47L 15/42 |
| EP | 05-56883 U | 8/1993 | | |
| JP | 57049976 A * | 3/1982 | | G03G 21/00 |
| JP | 11-38711 A | 2/1999 | | |
| JP | 11-109698 A | 4/1999 | | |
| JP | 11-327317 | 11/1999 | | |
| JP | 11327317 A * | 11/1999 | | G03G 21/16 |
| JP | 11-343005 A | 12/1999 | | |

(Continued)

OTHER PUBLICATIONS

Office Action in Japanese Patent Application No. 2009-067338, mailed Feb. 25, 2011 (with English translation).

(Continued)

*Primary Examiner* — Nguyen Ha
(74) *Attorney, Agent, or Firm* — Fitzpatrick, Cella, Harper & Scinto

(57) ABSTRACT

A color electrophotographic image forming apparatus for forming an image on a recording material, wherein plurality of cartridges are detachably mounted to a main assembly of the apparatus, the color electrophotographic image forming apparatus includes a cartridge supporting member for supporting the cartridges, the cartridge supporting member being movable between an inside position which is in the main assembly the outside position which is out of the main assembly; a belt unit including a feeding belt for feeding a recording material on which the image is to be formed; and locking means for locking the cartridge supporting member and the belt unit in the state that the feeding belt and the cartridge are contacted to each other, wherein the belt unit and the cartridge supporting member in the state of being locked by the locking means are movable from the inside position to the outside position, and the feeding belt and the cartridge are capable of being spaced from each other by releasing the locking means.

6 Claims, 10 Drawing Sheets

(56) References Cited

FOREIGN PATENT DOCUMENTS

| | | | | | |
|---|---|---|---|---|---|
| JP | 2000-122460 | A | | 4/2000 | |
| JP | 2002-174935 | A | | 6/2002 | |
| JP | 2003043848 | A | * | 2/2003 | ..... G03G 15/20 |
| JP | 2003207978 | A | * | 7/2003 | ..... G03G 15/00 |
| JP | 2006-126661 | A | | 5/2006 | |
| JP | 2006-276726 | A | | 10/2006 | |
| JP | 2007-218936 | A | | 8/2007 | |
| JP | 2007-304500 | A | | 11/2007 | |
| JP | 2008-58517 | A | | 3/2008 | |

OTHER PUBLICATIONS

Office Action in Japanese Patent Application No. 2009-067338, mailed Jun. 3, 2011 (with English translation).

* cited by examiner

COLOR ELECTROPHOTOGRAPHIC IMAGE FORMING APPARATUS

FIELD OF THE INVENTION AND RELATED ART

The present invention relates to a color electrophotographic image forming apparatus, wherein n a plurality of cartridges are dismountably mounted to a main assembly, and an image is formed on a recording material.

The process cartridge type is used increasingly in the field of an electrophotographic image forming apparatus, wherein a photosensitive drum and process means which acts on it are unified into a cartridge form, it carries out, and it is detachably mountable to the main assembly. In the electrophotographic image forming apparatus which forms a color image by overlaying different color images, it is known that the different color process cartridges are mounted, and different color developer images are transferred onto the recording material fed by a transportation belt to form the color image. More particularly, such a color electrophotographic image forming apparatus contains a plurality of process cartridges and a belt unit which includes the transportation belt for feeding the recording material.

As for the color electrophotographic image forming apparatus, a proposal for making a jam clearance for the recording material fed by the transportation belt and a replenishing operation of the process cartridge easy is made. In this proposal, the process cartridge and the transportation belt are retractable integrally in the direction perpendicular to a recording material feeding direction, and after it is drawn out, the jam clearance operation is enabled. In the course of the drawing out the drawer the transportation belt begins to space from the process cartridge, and when the process cartridge is drawn completely the space for the jam clearance operation is assured (Japanese Laid-open Patent Application Hei 11-327317).

However, with the above-described structure, the space for the spacing of the transportation belt is required. Correspondingly, it is preferable that the height of the main assembly is increased.

SUMMARY OF THE INVENTION

It is an object of the present invention to provide a color electrophotographic image forming apparatus including a cartridge supporting member, wherein the jam clearance property is satisfactory without increasing the height of the main assembly.

It is another object of the present invention to provide a color electrophotographic image forming apparatus including a cartridge supporting member, wherein an exchanging operation of a transportation belt unit is satisfactory.

According to an aspect of the present invention, there is provided a color electrophotographic image forming apparatus for forming an image on a recording material, wherein plurality of cartridges are detachably mounted to a main assembly of said apparatus, said color electrophotographic image forming apparatus comprising a cartridge supporting member for supporting said cartridges, said cartridge supporting member being movable between an inside position which is in said main assembly the outside position which is out of said main assembly; a belt unit including a feeding belt for feeding a recording material on which the image is to be formed; and locking means for locking said cartridge supporting member and said belt unit in the state that said feeding belt and said cartridge are contacted to each other, wherein said belt unit and said cartridge supporting member in the state of being locked by said locking means are movable from the inside position to the outside position, and said feeding belt and said cartridge are capable of being spaced from each other by releasing said locking means.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Figure 1:
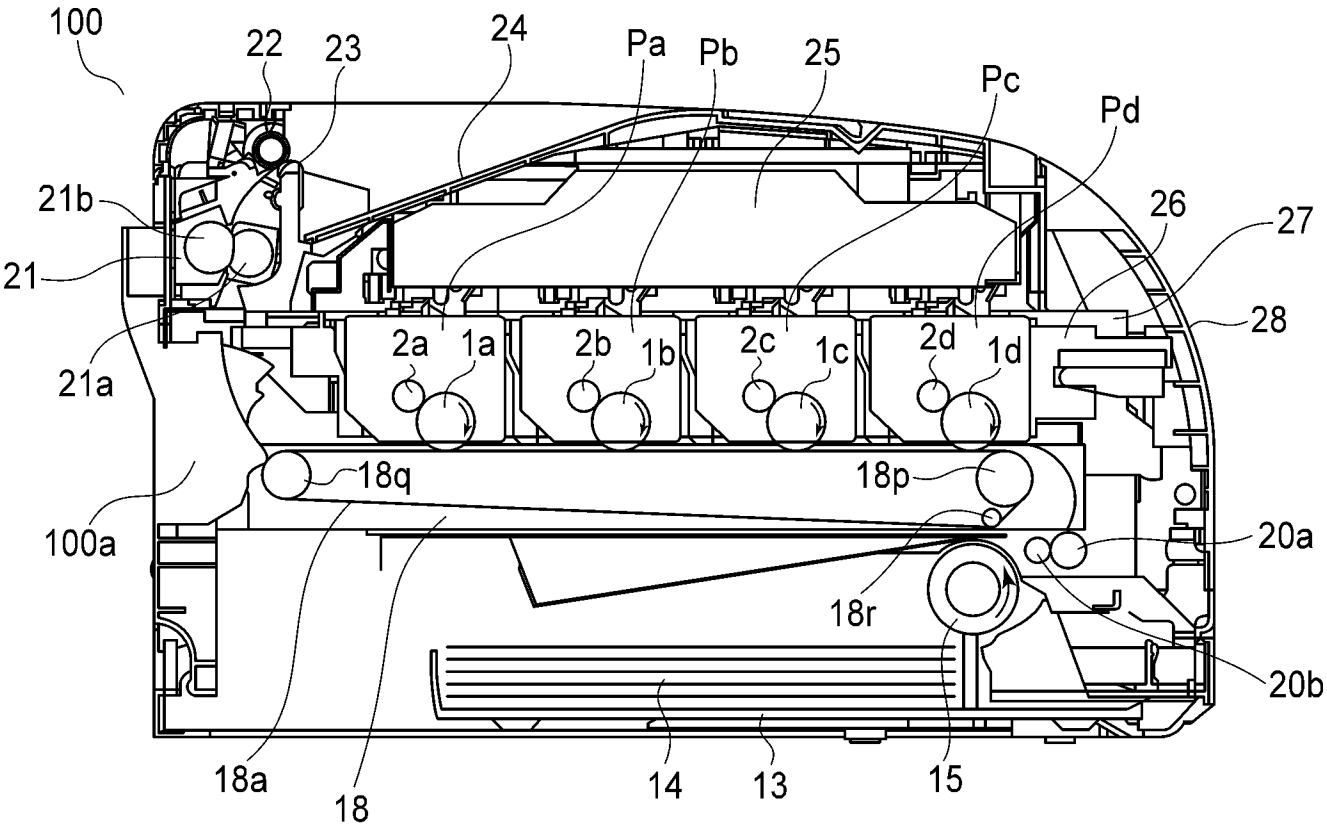
FIG. 1 is a sectional view of an image forming apparatus.

Referring to the accompanying drawings, the description will be made as to a color electrophotographic image forming apparatus, according to an embodiment of the present invention, for forming an image on a recording material, wherein a plurality of cartridges are dismountably mounted to a main assembly of the apparatus.

Here, the color electrophotographic image forming apparatus forms a color image on the recording material using an electrophotographic image forming process. The examples of the color electrophotographic image forming apparatus include a color electrophotographic copying machine, a color electrophotographic printer (color laser beam printer, color LED printer, for example), a color facsimile device, and a color word processor.

The image is formed by the electrophotographic image forming apparatus on a recording material, and the recording material is paper, an OHP sheet, for example.

The cartridge is a process cartridge, a developing cartridge or the like and contributes to an image forming process for forming the image on the recording material in the state that it is mounted to the main assembly of the electrophotographic image forming apparatus. Here, the process cartridge contains at least one of the charging means, developing means, cleaning means as process means, and the electrophotographic photosensitive drum as a unit integrally, and it is dismountably mountable to the main assembly of the electrophotographic image forming apparatus. The process cartridge may contain the developing means as the process means and the electrophotographic photosensitive drum as a unit, and it is dismountably mounted to the main assembly of the electrophotographic image forming apparatus. The process cartridge may contain the charging means, the developing means, or the cleaning means as the process means and the electrophotographic photosensitive drum as a unit, and it is dismountably mounted to the main assembly.

The process cartridge which is provided integrally with the electrophotographic photosensitive drum and the developing means is called an integral-type process cartridge. The process cartridge which is provided integrally with the electrophotographic photosensitive drum and the process means other than the developing means is called a discrete type process cartridge.

The process cartridge can be mounted to and dismounted from the main assembly of the image forming apparatus. For this reason, the maintenance of the apparatus is easy. The process means acts on the electrophotographic photosensitive drum.

The developing cartridge is provided with a developing roller, and an electrostatic latent image formed on the electrophotographic photosensitive drum is developed by the developing roller. It contains a developer (toner) for the development, and is dismountably mounted to the main assembly. In the case of the developing cartridge, the electrophotographic photosensitive drum is mounted to the main assembly or the cartridge supporting member as will be described hereinafter. Or, the electrophotographic photosensitive drum is provided in a so-called discrete type process cartridge. In this case, the process cartridge is not provided with the developing means. The developing cartridge is also mounted and demounted relative to the main assembly of the image forming apparatus by the user. For this reason, the maintenance of the apparatus is easy.

Therefore, the cartridge in this invention includes the process cartridges of a so-called the integral type or a so-called discrete type. The cartridge includes the combination of the so-called process cartridge of the discrete type and the developing cartridge. In another example of the cartridge, the electrophotographic photosensitive drum is mounted fixedly to the main assembly or the cartridge supporting member which will be described hereinafter and the detachably mountable developing cartridge acts on the electrophotographic photosensitive drum.

A first embodiment FIG. 1 is a sectional view of a laser printer which is a color electrophotographic image forming apparatus according to a first embodiment. The general arrangements and the functions of the laser printer will be described.

<General Arrangement of Color Electrophotographic Image Forming Apparatus>

First, referring to FIG. 1, the general arrangement of the color electrophotographic image forming apparatus (image forming apparatus) according to the first embodiment will be described. FIG. 1 is a sectional illustration of the image forming apparatus according to Embodiment 6.

The image forming apparatus 100 is a laser printer of a full-color (four colors) type which uses an electrophotographic process. The image forming apparatus 100 forms a full-color image on a recording material (sheet) S on the basis of the electrical image signal inputted to a control circuit portion 300 from an external host device 400 such as a personal computer, an image reader, a receiving part of a facsimile device.

In the image forming apparatus 100, a front side is a side which is provided with a door (opening and closing member) 28. A backside is the opposite side from it. The left and the right are the left and the right, as seen from the front side of the image forming apparatus.

As shown in FIG. 1, in image forming apparatus main assembly 100 (main assembly) a first-fourth horizontal process cartridges P (Pa, Pb, Pc, Pd) are juxtaposed from the backside to the front side.

Process cartridges (cartridges) P have the structures which are similar to each other except for the colors of the accommodated developer. A cartridge Pa accommodates a yellow developer. A cartridge Pb accommodates a magenta developer. A cartridge Pc accommodates a cyan developer. Pd accommodates a black developer.

According to this embodiment, the cartridge P is a so-called integral type, but, the present invention is not limited to it. The cartridge P may have the structure described above.

An upper portion of the cartridge P mounted to the main assembly 100*a* is provided with a laser scanner unit 25. A scanner unit 25 scanningly exposes the surface of the photosensitive drums 1 (1*a*, 1*b*, 1*c*, 1*d*) of each cartridge P to a laser beam. By this, an electrostatic latent image is sequentially formed on the photosensitive drum 1. Subsequently, the electrostatic latent image is developed by the developing means which is provided with developing roller 2 (2*a*, 2*b*, 2*c*, 2*d*), so that a developer image is formed on the photosensitive drum 1.

Below the cartridge P mounted to the main assembly 100*a* a transportation belt 18*a* for feeding the recording material is provided. The transportation belt 18*a* is stretched around a driving roller 18*p*, a follower roller 18*q*, and a tension roller 18*r*, and is rotated in the counter-clockwise direction in FIG. 1. A lower travelling surface of the photosensitive drum 1 of each cartridge P is in contact to an upper travelling surface of the transportation belt 18*a*.

A pair of feeding rollers 20*a* and 20*b* is provided in the upstream side of the transportation belt 18*a* with respect to a recording material feeding direction. At the time of the feeding of the recording material 14, the recording material 14 stacked in a feeding tray 13 is fed by a feeding roller 15 rotated in the counter-clockwise direction in FIG. 1. The recording material 14 is fed onto the transportation belt 18*a* by feeding roller pair 20*a* and 20*b*. An attraction roller (unshown) contacts to the transportation belt 18*a*, and a voltage is applied to the attraction roller. By this, a recording material 14 is electrostatically attracted on an outer surface of the transportation belt 18*a*. The transportation belt 18*a* is circulated by the driving roller 18*p*, while contacting the recording material 14 to the photosensitive drum 1. By this, the recording material 14 is fed to a transfer position by the transportation belt 18*a*. The recording material 14 receives the developer image from the photosensitive drum 1 by a bias voltage application to a transfer roller (unshown).

Furthermore, the recording material having the developer image transferred thereonto 14 is fed to fixing means 21. The fixing means 21 is provided with a thin fixing film 21*a* telescoped around film holder and a pressing roller 21*b*, and the fixing film 21*a* is heated by a heater. In a nip between the fixing film 21*a* and the pressing roller 21*b*, the recording material 14 having the developer image transferred there onto is heated and pressed. By this, the fixing means 21 fixes the developer image on the recording material 14.

The recording material having the developer image fixed thereon 14 is discharged to a discharging tray 24 by the pair of discharging rollers 22 and 23.

In this embodiment, for the usability improvement, the tray 26 is drawn from the main assembly 100*a* in the state that the cartridges P are supported on the cartridge tray 26 (cartridge supporting member). Therefore, the user can exchange the cartridge 33 easily. A tray 26 is slidable relative to the main assembly 100*a*.

The transportation belt 18*a*, the driving roller 18*p*, the follower roller 18*q*, and the tension roller 18*r* are unified into a belt unit 18, and the belt unit 18 is detachably mountable relative to the main assembly 100*a*.

<The Cartridge Tray and Belt Unit>

Referring to FIG. 1-FIG. 21 as to a mounting and demounting structure of the tray 26 and a unit 18, the description will be made.

In each cartridge P, the developer contained in the developing means is consumed as it is used for the image formation. When the developer is consumed up, an exchange of the cartridge P is required.

For the usability improvement, the exchange of the cartridge P is the state that the cartridge P is carried to the tray 26 and is carried out in the image forming apparatus of this embodiment.

The tray 26 is movable between an inside position (FIG. 1) placed in the inside of the main assembly 100*a* to support the cartridge P and an outside position (FIG. 5) placed in the outside of the main assembly 100*a*.

For this reason, the front side of the main assembly 100*a* is provided with an opening portion 31 (FIG. 4) for passing the cartridge P to insert the cartridge P in the main assembly 100*a* and to dismount the cartridge P from the main assembly 100*a*.

The door (opening and closing member) 28 movable between a closed position for closing the opening portion 31 and an open position for opening the opening portion 31 are provided.

In the respective sides inside the opening portion 31, a tray holding member (main assembly side holding member) 27 which comprises the left and right rail members extended in a front-rear direction is provided. The tray 26 is supported by the tray holding member 27, and is slidable in the direction (front-rear direction) in which the cartridges P are arranged.

Figure 2:
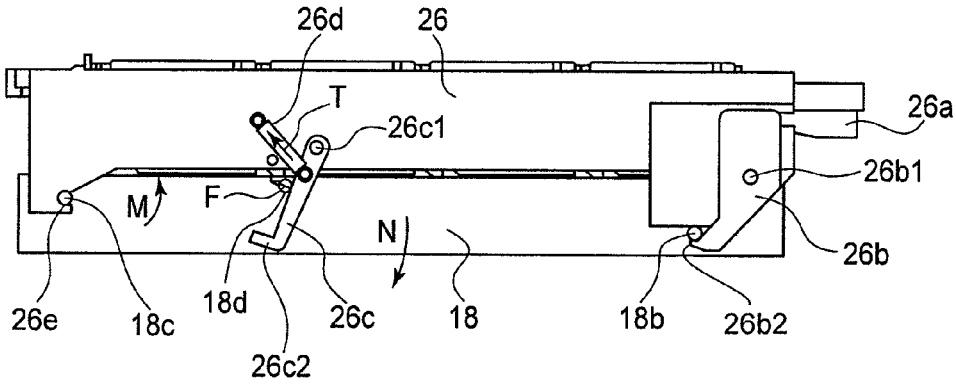
FIG. 2 is an illustration of a lock structure for a cartridge tray and a belt unit.

FIG. 2 shows only the tray 26 and the unit 18. Positioning bosses 18*b* and 18*c* protrude in the predetermined positions of the unit 18. The boss 18*c* on the backside engages with the positioning groove 26 provided in the backside of the tray 26*e*, and the boss 18*b* of the front side is held by a locking member 26*b*. The locking member 26*b* constitutes the locking means for locking the unit 18 in the state that it is locked with the tray 26. The locking member 26*b* is mounted to the tray 26 rotatably about the shaft 26*b*1. The locking member 26*b* is in engagement with a releasing lever 26*a* mounted to the tray 26. The locking member 26*b* is urged in the clockwise direction in FIG. 2 by the urging means (unshown) of a spring or the like. By this, a free end locking portion 26*b*2 locks with the positioning boss 18*b*, and the locking member 26*b* is locked in the state that the tray 26 and the unit 18 are connected with each other. In this locked state, the photosensitive drum 1 of the cartridge P mounted to the tray 26 is positioned so as to contact to the transportation belt 18*a*.

On the other hand, when the releasing lever 26*a* is pressed against the backside of the main assembly 100*a*, the locking member 26*b* engaged therewith rotates in counter-clockwise direction of FIG. 2. The locking member 26*b* is released from the positioning boss 18*b*, and unlocked state is established.

In the substantial middle position, with respect to the front-rear direction, of the tray 26, a damper mechanism is provided. The damper mechanism comprises a damper stopper 26*c* rotatable about the shaft 26*c*1, a tension spring 26*d* for urging the damper stopper 26*c* in a clockwise direction of FIG. 2, the boss 18*d* provided on the belt unit 18. The operation of the damper mechanism will be described hereinafter.

Figure 3:
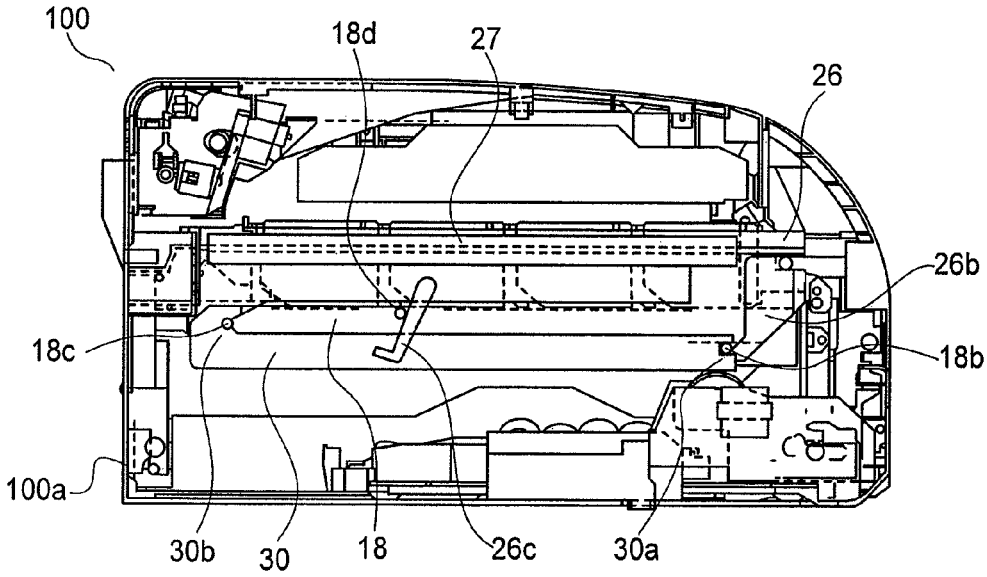
FIG. 3 illustrates a positioning structure between the cartridge tray and the belt unit.
Figure 4:
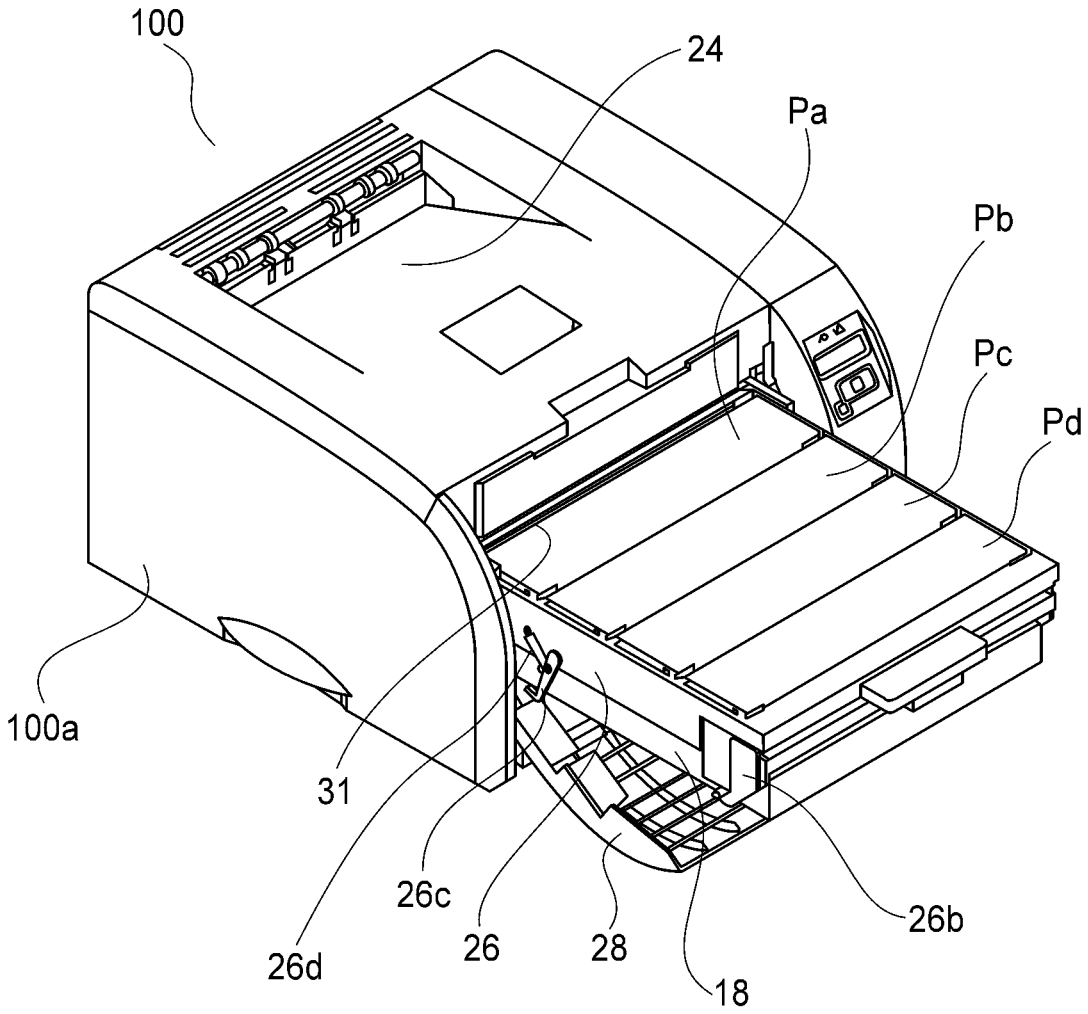
FIG. 4 is a perspective view illustrating the state that the cartridge tray and the belt unit are drawn out.

FIG. 3 is a sectional view of the main assembly which shows a positioning portion between the tray 26 and the unit 18. The tray 26 is roughly supported by the tray holding member 27 which is provided in main assembly 100*a*. When the tray 26 is in the inside position, the positioning bosses 18*b* and 18*c* of the unit 18, and 18*c* engages with the positioning grooves 30*a* and 30*b* which are provided on a positioning member 30 provided in main assembly 100*a*. By this, the unit 18 and the tray 26 are positioned in the main assembly 100*a*.

The cartridge P is roughly supported by the tray 26. When the tray 26 is mounted to the inside position in the main assembly 100*a*, the cartridge P is positioned to the positioning portion (unshown) of the positioning member 30 provided in the main assembly 100*a*. By this, the cartridge P is positioned in the main assembly 100*a*.

As described above, in the state that the tray 26 and the unit 18 are locked by the locking means, and the tray 26 is in the inside position, the unit 18 and the cartridge P are positioned relative to the same positioning member 30. For this reason, they are positioned with high precision relative to the main assembly.

Figure 5:
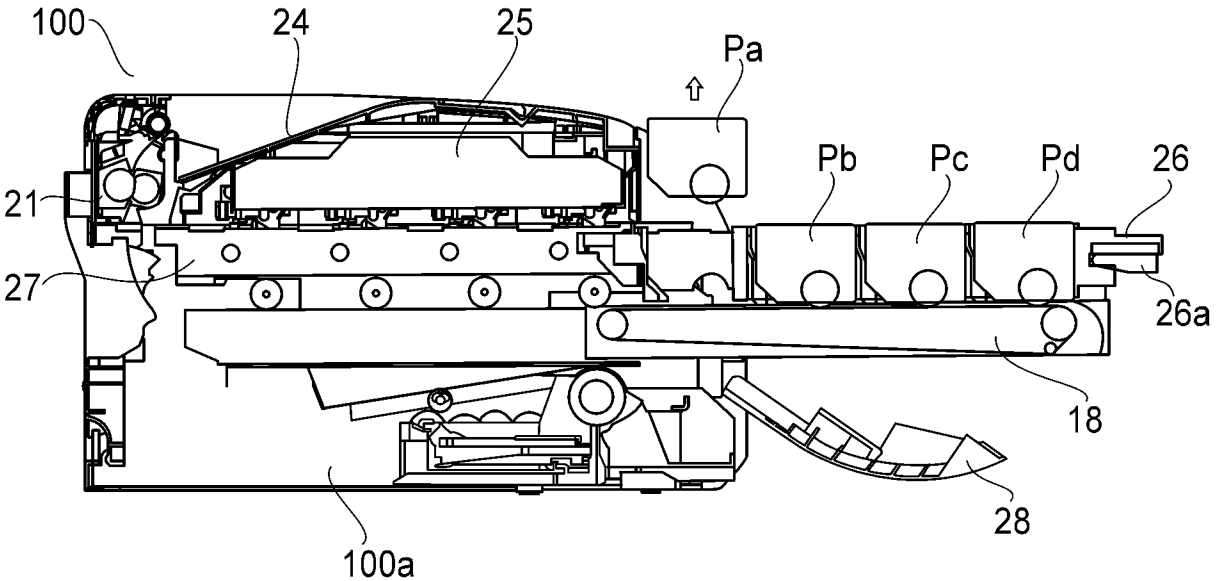
FIG. 5 illustrates the replenishment of a cartridge.

FIG. 5 shows the state in which the tray 26 is drawn to be in the outside position after opening a front door 28. In this position, the upper portion of the cartridge P is opened, and the cartridges P can be dismounted.

In drawing the tray 26, the tray 26 and the unit 18 are locked by the locking means. For this reason, they are drawn integrally from the main assembly 100*a*. At this time, the tray 26 and the unit 18 do not space from each other while drawing. For this reason, the space for spacing the tray 26 and the unit 18 from each other is unnecessary in the main assembly 100*a*, and therefore the height of the main assembly 100*a* can be kept low.

The removing direction of the tray 26 and unit 18 is the front-rear direction of the main assembly of the main assembly 100*a* in which four cartridges P are arranged. For this reason, it is not necessary to provide the large opening portion for simultaneously taking out a plurality of cartridges P in the left and right side surfaces of the main assembly 100*a*. For this reason, strength of the main assembly 100*a* is not decreased.

<Jam Clearance Operation>

Figure 6:
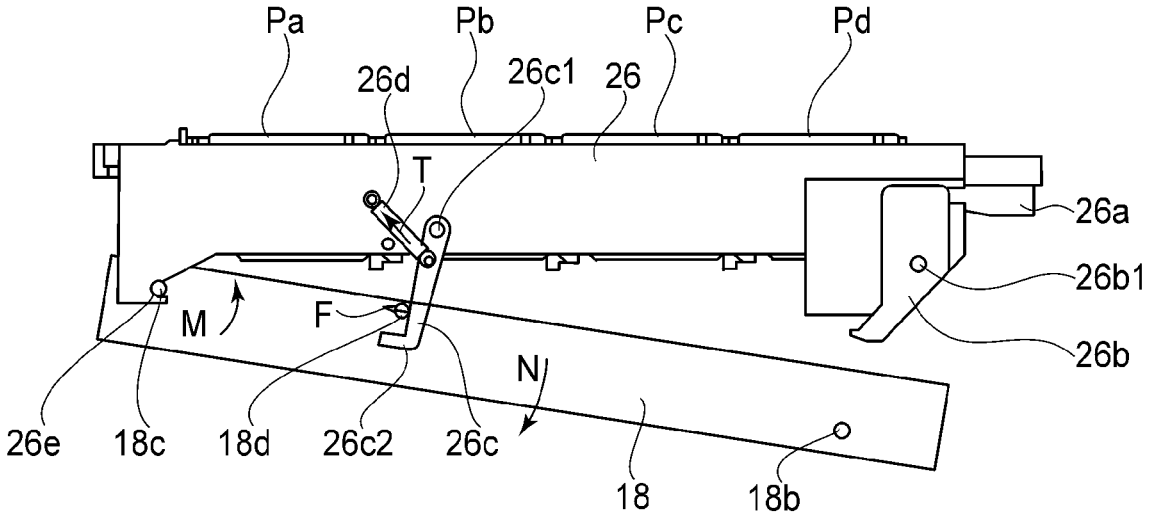
FIG. 6 illustrates spacing of the belt unit from the cartridge tray.
Figure 7:
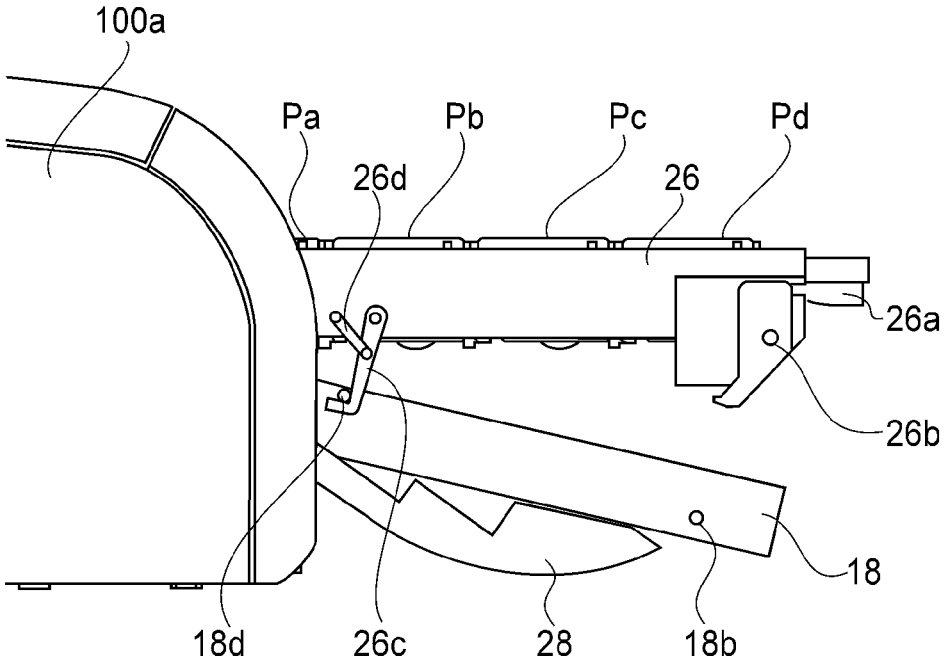
FIG. 7 illustrates the spacing of the belt unit from the cartridge tray.

The jam clearance operation will be described. As has been described hereinbefore, in the state of FIG. 5 in which the tray 26 is drawn, the user pushes the releasing lever 26*a*. By this, the locking member 26*b* rotates so as to release the engagement with the positioning boss 18*b*. As shown in FIGS. 6 and 7, by this, the unit 18 can be spaced from the tray 26, and the unit 18 begins to descend about the positioning boss 18*c* on the backside. At this time, the unit 18 descends slowly by the function of the damper stopper 26*c*.

The damper stopper 26*c* is pulled in the direction of the arrow T in FIG. 6 by the tension spring 26*d*, to apply the force of a direction of the arrow F to the boss 18*d*. By this force, to the unit 18, rotation moment M (counter-clockwise direction in FIG. 6) applies to provide a retarding force against a rotation moment N by the weight of the unit 18. The unit 18 is stopped where the boss 18*d* abuts to a locking portion 26*c*2 of the damper stopper 26*c*.

At this time, sufficient gap is provided between the tray 26 and the unit 18. For this reason, even if a jamming occurs on the unit 18, the user can clear the jammed sheet easily.

In this embodiment, the nip releasing means is provided. When a jamming is detected, the nip releasing means releases the nip state of the nip of the fixing means. By this, even if the recording material nipped in the nip of the fixing means is jammed, the jamming is cleared easily.

Figure 8:
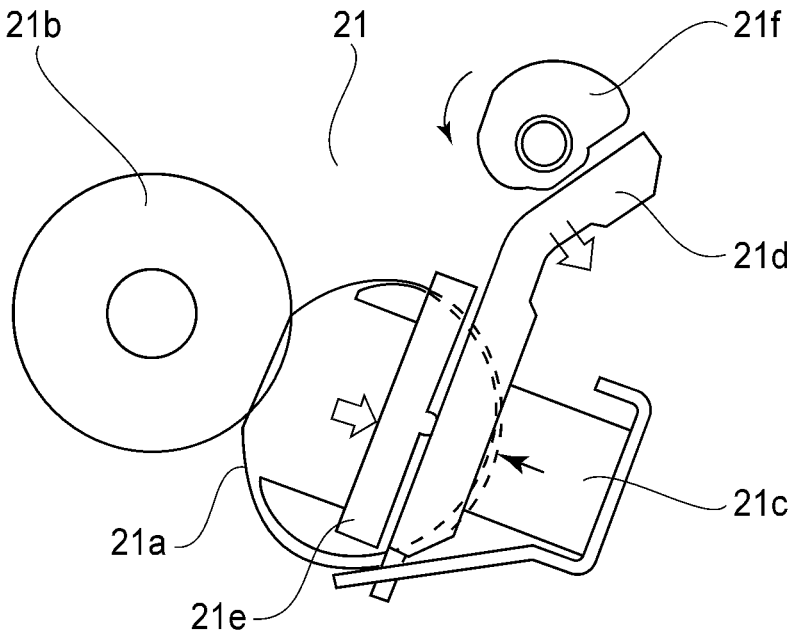
FIG. 8 is an illustration of the nip releasing means for releasing a nip of fixing means.

In the normal state, in the fixing means 21, the fixing film 21*a* and the pressing roller 21*b* are press-contacted to each other (FIG. 8). At this time, through a pressure plate 21 *d* rotatable about a fulcrum by the compression spring 21 *c*, the film holder 21*a* which holds the fixing film 21 *e* receives an urging force. By this, the fixing film 21*a* and the pressing roller 21*b* are press-contacted to each other to be in the nipping state.

Figure 9:
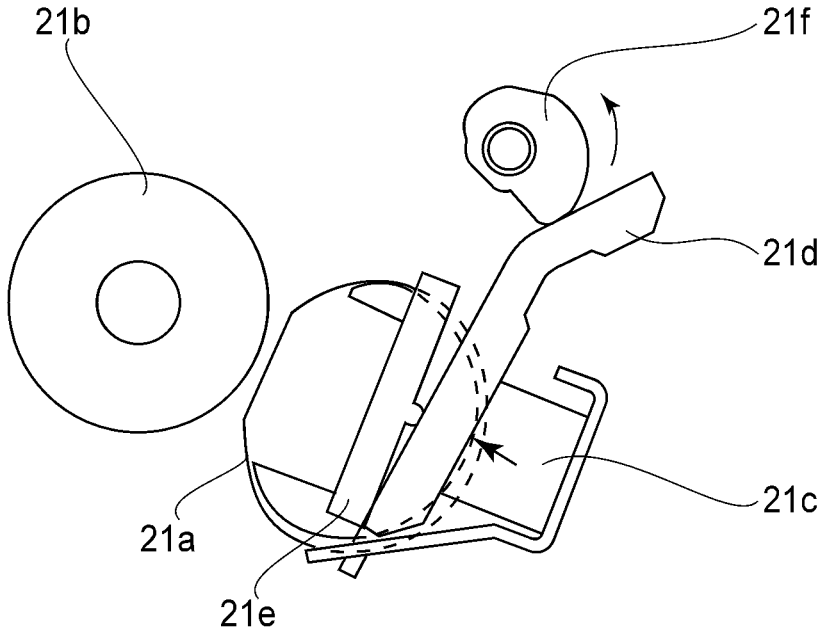
FIG. 9 is an illustration of the nip releasing means for releasing a nip of fixing means.

When the nipping state is released by the nip releasing means, a pressure releasing cam 21 *f* rotates (FIG. 9). By this, the pressure plate 21 *d* rotates in the clockwise direction (direction of an arrow a in FIG. 9) about the fulcrum. By this, the urging force of the compression spring 21 *c* is removed, so that the fixing film 21*a* and the film holder 21 *e* are spaced from the pressing roller 21*b* (releasing of the nipping state).

When the pressure releasing cam 21 *f* rotates in the opposite direction from the nip released state, the pressure plate 21 *d* urges the film holder 21 *e*, and therefore the fixing film 21*a* and the pressing roller 21*b* returns to the nip state.

Figure 10:
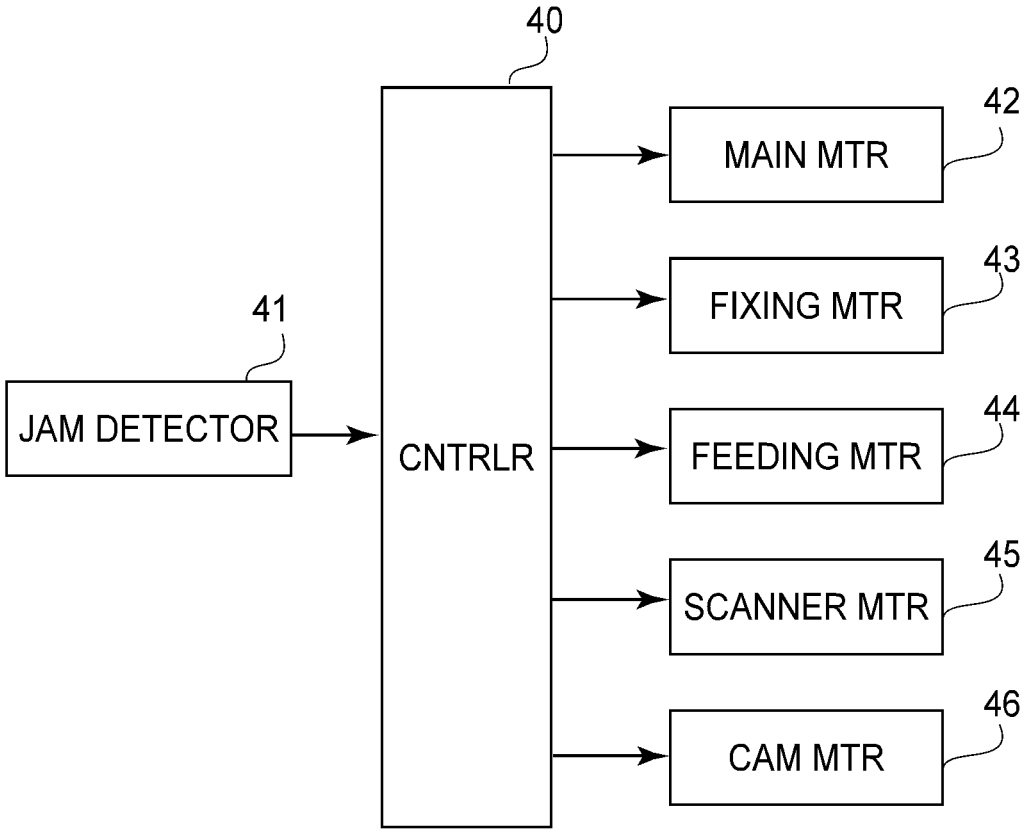
FIG. 10 is a block diagram of a drive controller.

The nip releasing is controlled, so that the nip releasing means operates automatically when jam detecting means detects jamming. More particularly, as shown in FIG. 10, the drive controller 40 receives a detected signal from the jam detecting means 41 for detecting jamming of the recording material 14. A controller 40 controls the drive of a Main motor 42 for driving the photosensitive drum 1 and the belt unit 18. Furthermore, the controller 40 controls a fixing motor 43 for driving the fixing means, a feeding motor 44 for driving the feeding roller 15 and so on, a scanner motor 45 for driving the scanner unit 25, and a cam motor 46 for driving the pressure releasing cam 21*f*. Here, the jamming is the jamming, in the feeding path, of the recording material 14.

Figure 11:
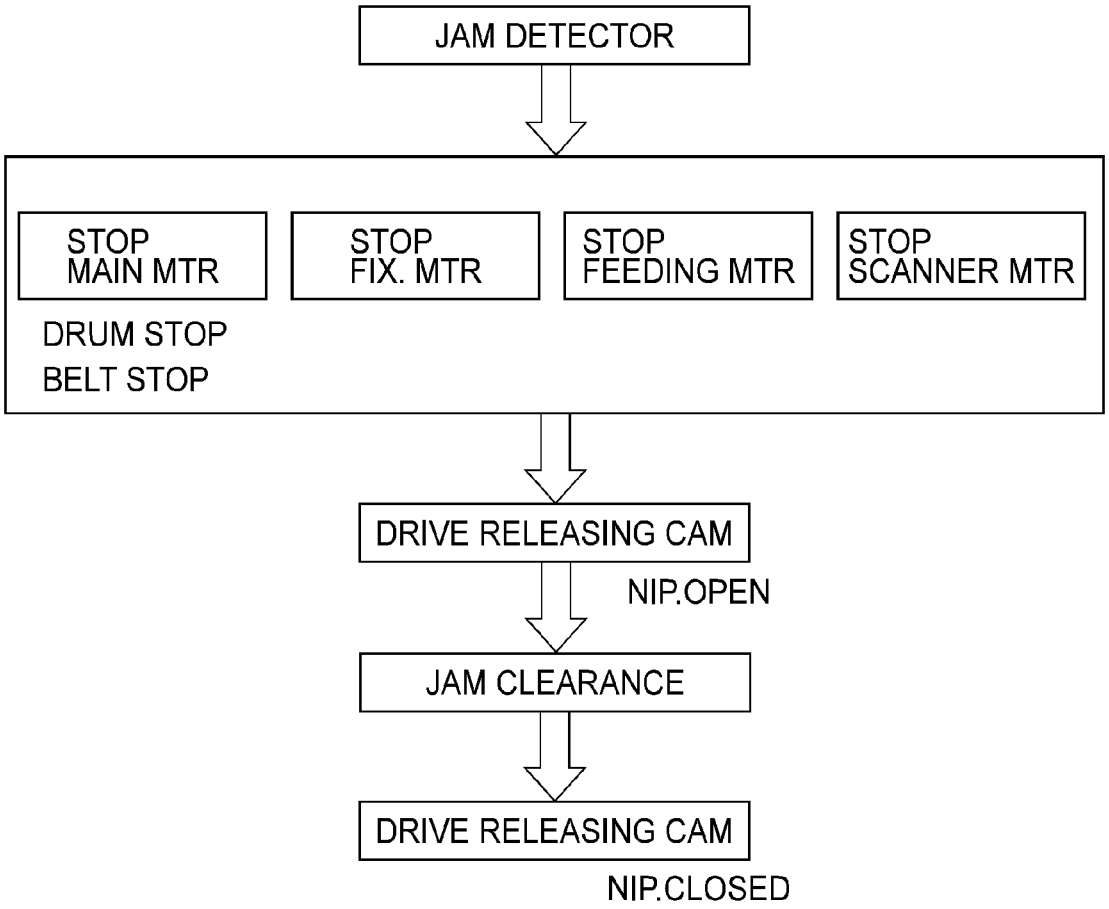
FIG. 11 is an illustration of a drive control operation at the time of a jam clearance operation.

As shown in FIG. 11, when the jam detecting means 41 detects the jamming of the recording material 14, the controller 40 stops the motors 42, 43, 44 and 45 in response to the detected signal. The controller 40 drives the cam motor 46. By this, with the stoppage of the device, the nip of the fixing means 21 is released.

In the above-described structure, referring to the (a)-(c) of FIG. 12, the jam clearance operation method for the recording material 14 will be described when the jamming occurs at the portions of the unit 18.

Figure 12:
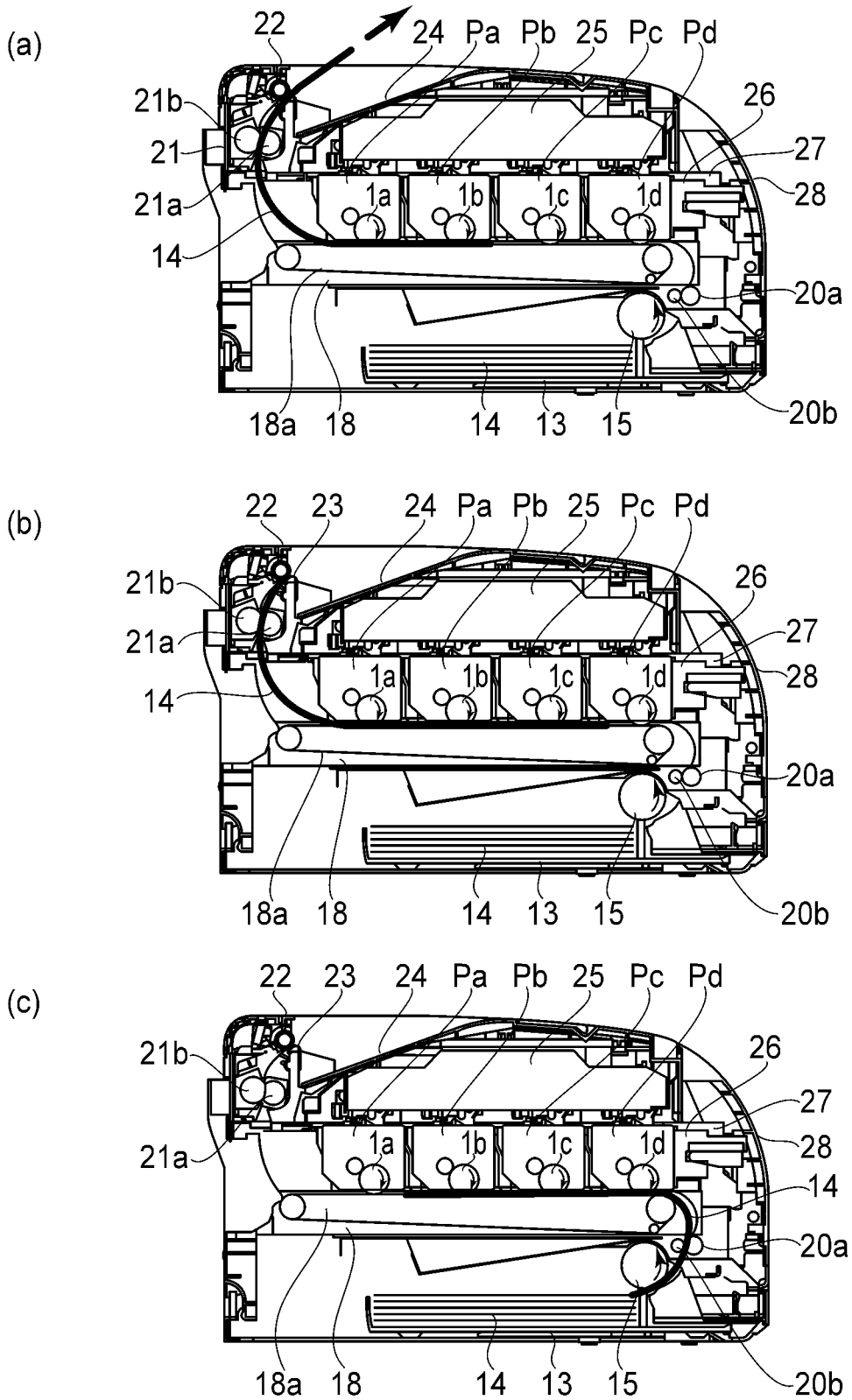
FIG. 12 is an illustration of a jam clearance operation method.

As shown in (a) of FIG. 12, when the recording material 14 is jammed in the position in which it is nipped by the nip of the fixing means 21, and a free end of the recording material 14 is exposed from the discharging roller pair 22, 22, the nip of the fixing means 21 is released as has been described hereinbefore. The nipping force for the recording material 14 by the transportation belts 18*a* and photosensitive drums 1*a*, 1*b* is weak. For this reason, the user can pull out the recording material 14 in the direction indicated by an arrow from the discharging tray 24 side.

As shown in (b) of FIG. 12, when the recording material 14 is jammed in the position in which it is nipped by the nip of the fixing means 21, the free end of the recording material 14 is not exposed from the discharging roller pair 22, 22, the nip of the fixing means is released. For this reason, the user opens the door 28, and the tray 26 and the unit 18 are drawn to the outside position. As has been described hereinbefore, the user releases the lock to space the unit 18 from the tray 26. By this, a feeding path of the recording material 14 is exposed, so as to enable the easy jam clearance operation.

As shown in (c) of FIG. 12, when the recording material 14 is jammed in the position in which it is nipped by feeding roller pair 20*a* and 20*b*, the jam clearance operation is as follows. The driving force is transmitted from the motor 44 to the feeding roller pair 20*a* and 20*b* through drive transmitting means. However, when the jamming is detected by the jam detecting means, the transmission of the driving force from the feeding roller pair 20*a* 20*b* from the drive transmitting means is blocked. For this reason, feeding roller pair 20*a* and 20*b* are in the rotatable state.

In this embodiment, at least a part of the drive transmitting means is a one-way-clutch. A driving force is transmitted to feeding roller pair 20*a* and 20*b* through the one-way-clutch. For this reason, in the state that the motor 44 stops, the Feeding roller pair 20*a* and 20*b* are rotatable in one direction. The door 28 is opened for the state shown in (c) of FIG. 12. And, the tray 26 and the unit 18 are drawn integrally, and the feeding roller pair 20*a* and the recording material 14 nipped by roller 20*b* are pulled out. At this time, feeding roller pair 20*a* and 20*b* are rotatable, and therefore the recording material 14 is smoothly pulled out of the feeding roller pair nip 20*a*, 20*b*. Thereafter, as has been described hereinbefore, the user spaces the unit 18 from the tray 26, and the jam clearance operation can be carried out easily.

In this embodiment, although the one-way-clutch for a driving train to feeding roller pair 20*a* and 20*b* is used, an electromagnetic clutch may be used for the driving train. After the jam detecting means detects the jamming energization of the electromagnetic clutch may be blocked.

<Exchange of Belt Unit>

Figure 13:
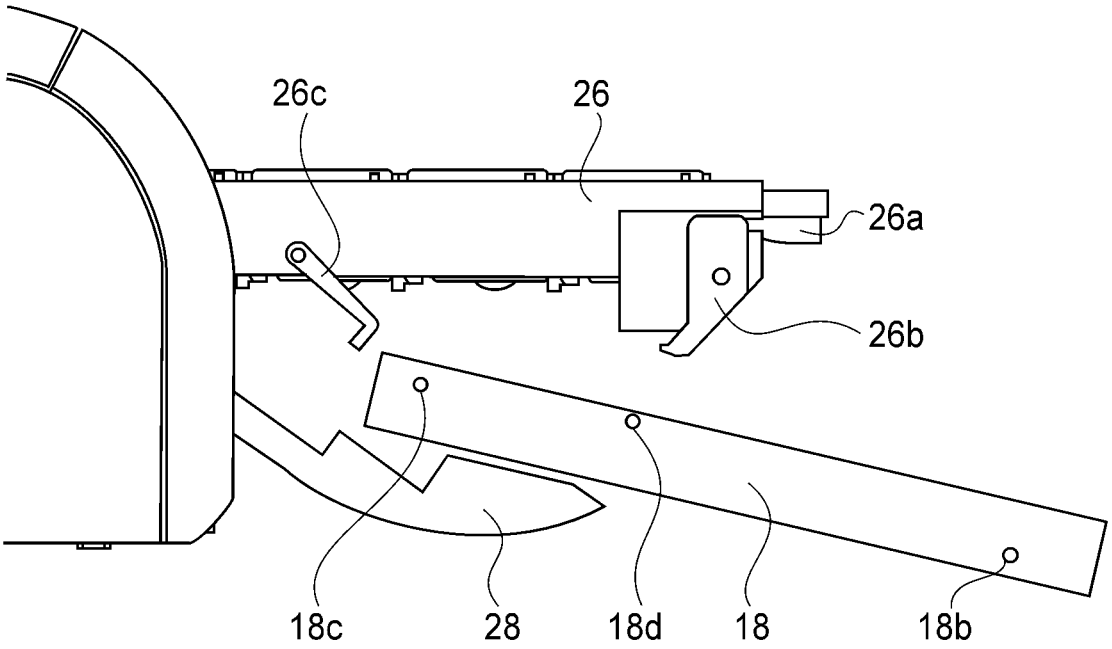
FIG. 13 is an illustration of the replenishing operation of the belt unit.

A replenishing method of the belt unit 18 will be described. The damper stopper 26*c* is rotated from the state shown in FIG. 7. By this, as shown in FIG. 13, the engagement between the locking portion 26*c*2 and the boss 18*d* is released. By this, the unit 18 is completely spaced from the tray 26, and, and it can be taken out. By this, when the unit 18 reaches a lifetime, for example, the unit 18 can be exchanged easily.

As described above, in the image forming apparatus of this embodiment, the jam clearance operation and the exchange of the belt unit 18 are easy without increasing the main assembly height, without decreasing the strength. According to the embodiment described above, in the state that the tray 26 (cartridge P) and the belt unit 18 and locked, the removal of main assembly 100*a* is carried out, and therefore, it is not necessary that the cartridge P is spaced from the belt unit 18 inside of the main assembly 100*a*. For this reason, it is not necessary to provide the space for spacing the cartridge P and the belt unit 18 from each other in the main assembly 100*a*, and therefore, the height of the main assembly 100*a* can be kept low.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 067338/2009 filed Mar. 19, 2009 which is hereby incorporated by reference.

What is claimed is:

1. A color electrophotographic image forming apparatus for forming an image on a recording material, wherein a plurality of cartridges are detachably mounted to a main assembly of said apparatus, said color electrophotographic image forming apparatus comprising:

a cartridge supporting member for supporting said cartridges, said cartridge supporting member being movable between an inside position which is inside said main assembly and an outside position which is outside of said main assembly;

a belt unit including a feeding belt for feeding a recording material on which the image is to be formed, wherein said belt unit is movable relative to said cartridge supporting member between a contact position in which said belt unit is in contact with said cartridges and a spaced position in which said belt is spaced from said cartridges;

an urging member engaging said cartridge supporting member and said belt unit; and a locking means for locking said cartridge supporting member and said belt unit in the state that said feeding belt and said cartridges are contacted to each other, wherein said belt unit is descendible from the contact position to the spaced position by a weight of said belt unit against an urging force of said urging member by releasing said locking means at the outside position, and wherein moving directions of said cartridge supporting member and said belt unit are parallel with a direction in which said cartridges are arranged and a moving direction of said feeding belt.

2. An apparatus according to claim 1, wherein electrophotographic photosensitive drums contained in said cartridges are contacted to said feeding belt in locking said cartridge supporting member and said belt unit in the state that said feeding belt and said cartridges are contacted to each other by said locking means.

3. An apparatus according to claim 1, further comprising:

fixing means for fixing an image in a nip while nipping the recording material having the image;

nip releasing means for releasing nipping of said nip; and jam detecting means for detecting jamming of the recording material, wherein said nip releasing means is operated in response to jam detection of said jam detecting means to release the nipping of said nip to permit removal of a jammed recording material.

4. An apparatus according to claim 1, further comprising:

driving force transmitting means for rotating a feeding roller; and jam detecting means for detecting jamming of the recording material, wherein transmission of a driving force from said driving force transmitting means to said feeding roller in response to jam detection of said jam detecting means permits removal of the recording material jammed by said feeding roller.

5. An apparatus according to claim 3, wherein said driving force transmitting means transmits the driving force to said feeding roller through a one-way clutch.

6. An apparatus according to claim 3, wherein said driving force transmitting means transmits the driving force to said feeding roller through an electromagnetic clutch.

* * * * *